United States Patent [19]

Chanton

[11] 4,104,009

[45] Aug. 1, 1978

[54] SCREW PUMP STATORS

[75] Inventor: Edmond Chanton, Clamart, France

[73] Assignee: Societe Generale de Mecanique et de Metallurgie, Vanves, France

[21] Appl. No.: 774,650

[22] Filed: Mar. 4, 1977

[30] Foreign Application Priority Data

Mar. 9, 1976 [FR] France ..... 76 06736

[51] Int. Cl.[2] ..... F04C 1/02

[52] U.S. Cl. ..... 418/48

[58] Field of Search ..... 418/48, 152, 153

[56] References Cited

U.S. PATENT DOCUMENTS

| | | | |
|---|---|---|---|
| 1,892,217 | 12/1932 | Moineau | 418/48 X |
| 3,011,445 | 12/1961 | Bourke | 418/48 X |
| 3,802,803 | 4/1974 | Bogdanov et al. | 418/48 X |

FOREIGN PATENT DOCUMENTS

| | | | |
|---|---|---|---|
| 1,528,978 | 7/1969 | | 418/48 |

*Primary Examiner*—Carlton R. Croyle
*Assistant Examiner*—Leonard Smith
*Attorney, Agent, or Firm*—Ostrolenk, Faber, Gerb & Soffen

[57] ABSTRACT

The invention relates to screw pump stators having a rigid tubular body lined on the inside with a resilient sleeve.

The sleeve comprises a twisted liner (4) having inner bosses (5) and outer bosses (6) in the zones thereof corresponding to the highest sliding speeds of the rotor, the outside bosses projecting more than the inner bosses, and the inside surface of the rigid body (3) is hollowed out so as to sealingly receive the outer bosses of the liner.

5 Claims, 5 Drawing Figures

SCREW PUMP STATORS

The invention relates to screwpumps, i.e. pumps comprising two helical gears one inside the other and engaged with each other at all times at least according to a line of helical trend, the rotatable internal gear, or "rotor" having a number of teeth equal to $n$ ($n$ being a whole number at least equal to 1), the fixed outer gear, or stator, having a number of teeth equal to $n + 1$ and the pitches of the screws of these two inside and outside gears being respectively in the ratio $n/(n+1)$.

When the rotor of such a pump is rotated, it drives continuously from one of its axial ends to the other volumes of material (generally a more or less viscous liquid) which are contained between it and the stator, immediately downstream of the rotor-stator engagement lines.

The stators of these pumps are generally formed of a rigid tubular body, preferably of metal, lined inside with a resilient sleeve, preferably an elastomer material.

Two forms of embodiment of such stators are known:

in the stators of the first type, the rigid body is formed from a tube limited at least inside by a cylindrical surface, the resilient sleeve then being of very variable thickness along its periphery so as to present both, on the outside, a cylindrical surface sealingly mating with the inside surface of the tube and, on the inside, the helically formed surface required to cooperate with the rotor;

in the stators of the second type, the rigid body itself has a helically formed inner surface similar to that required for cooperation with the rotor, the resilient sleeve the being in the form of a helically deformed sock of constant thickness over the whole of its length.

Each of these types has the following disadvantages:

in the first one, the thick areas of the resilient sleeve are more deformable by the pression and more extendable by heating than the thin areas, which causes local distorsions and blockages harmful to the efficiency of the pumping;

in the second type, it is not possible to obtain, without using a packing, a tight and even fit of the rotor in the stator, a good seal at the lines of contact between this rotor and this stator and therefore efficient pumping depending on this fit; furthermore the life of the stator is relatively short because of wear on the internal wall of the sleeve in the areas against which the rotor slides at the greatest speed.

The invention seeks to remedy these different disadvantages.

The stators for screw pumps according to the invention are essentially characterised in that their resilient sleeve is formed by a twisted liner whose thickness varies along the periphery of each transverse section, this thickness being the greatest in those areas where the sliding speeds of the rotor are the highest, these thickened areas forming bosses both on the outer surface and on the inner surface of this liner, and in that their rigid body has an inner surface whose general form is similar to that of the inner surface of the twisted liner, but hollowed at the bosses of this liner so as to receive the outer bosses thereof in a sealing manner.

The areas in question, on the inner surface of the stator, against which the rotor moves with sliding friction at the highest speed, are the central parts of its interior zones which have not been hollowed out, that is to say the "flat" or "bulging" parts at the central parts of the stator. The hollowed out zones of this inner surface being on the contrary those along which the rotor-stator sliding speed is the lowest.

In the preferred embodiments, one and/or the other of the following arrangements is used:

the maximum thickness of each outside boss is at least ten times greater than the maximum thickness of the corresponding inside boss, the thickness of each outside boss is greater than the thickness of the liner wall in the thinnest zone, for a stator intended to cooperate with a rotor of circular cross-section of 50 mm diameter and 10 mm excentricity, having a resilient liner with a minimum thickness of 5 mm in its most curved areas, the maximum thickness of the inner bosses of the liner is approximately 5 to 10 mm.

The invention comprises, apart from these principal arrangements, certain others which are preferably used at the same time and which will be discussed herebelow;

There will now be described two preferred embodiments of the invention with reference to the accompanying drawings, these descriptions being in no wise limitative of the invention.

FIG. 1 of these drawings is a diagrammatic cross-section of a conventional screw pump having a rotor with a circular cross-section and a stator of the two-teeth gear type.

Figure 1:
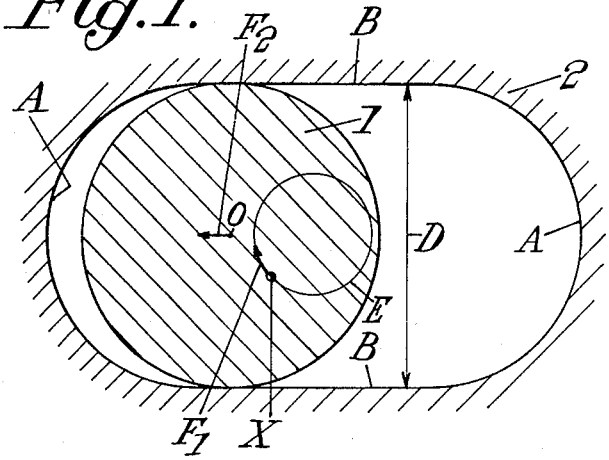
Figure 2:
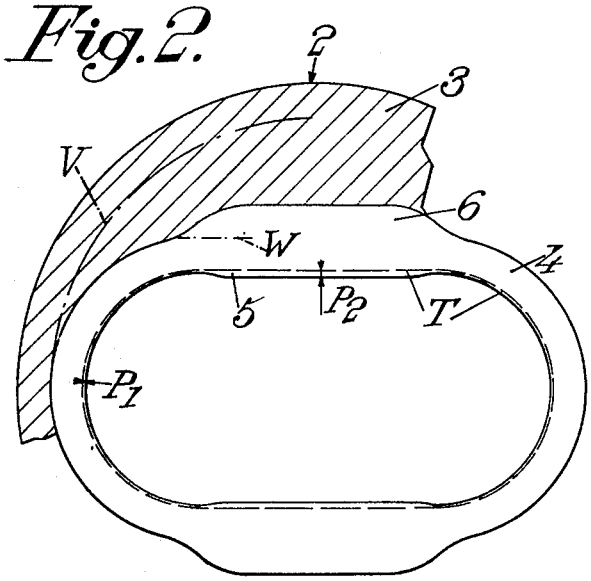
FIG. 2 shows in partial cross-section the stator of such a pump constructed according to the invention.

In the preferred embodiment shown in FIGS. 1 and 2, the rotor 1 of the screw pump has for cross-section a circle of diameter D, the cross-section of the inner surface of stator 2 being substantially defined by two semicircles A of diameter D joined together by two parallel rectilinear sections B of the same length.

Circle E of FIG. 1, whose radius is equal to the "excentricity" of the rotor, is the section of the transverse plane considered through the locus of axis X of this rotor when the pump is in operation.

From the position shown in FIG. 1 axis X moves in the direction of arrow $F_1$ on this circle E, whereas the centre O of the cross-section of the rotor moves leftwards as shown by arrow $F_2$: rotor 1 moves angularly anti-clockwise whilst its periphery slides frictionally against the adjacent surface of the stator.

After reaching the left-hand end of its travel in FIG. 1, the section considered of rotor 1 sets off again towards the right while continuing to rotate in the same anti-clockwise direction whilst its axis X describes the upper part of circle E towards the right, and so on.

With the rotor rotating at constant speed about its axis X, the speed at which this rotor frictionally slides against the stator varies considerably along the inner surface of this latter: it is usual for the value of this speed corresponding to the middles of the two rectilinear segments B to be approximately double the corresponding value of said speed at the ends of these segments.

Now, the degree of wear of the rubbed surface of the stator at the different points of this surface varies in the same way as the sliding speed at the points considered.

The rubbed surface in question defines on the inside, in a conventional way, a a twisted resilient liner 4 lining the inside of a rigid body 3, this liner and body assembly forming stator 2.

To reduce the degree of wear in those areas of the liner which correspond to the highest sliding speeds, according to the invention the wall of this liner 4 is thickened at right angles to the areas corresponding to the highest sliding speeds.

These thickened portions correspond to bosses of low height 5 inwards of liner 4 and to much higher bosses 6 outwards of the liner, the height of the second ones being generally more than ten times greater than that of the first ones.

The inner surface of liner 4 is, apart from the inner bosses 5, similar to those of conventional stators of the kind considered.

The inner surface of the rigid body 3 resembles this inner surface of the liner but it is specially hollowed out at the outer bosses 6 of this liner so as to sealingly receive these latter.

Since in reality these latter are in the form of meandering ribs extending longitudinally along the outside wall of said liner, the recesses formed in body 3 to receive them are themselves in the form of meandering furrows extending correspondingly.

To determine the thicknesses of the different bosses, the following considerations should preferably be taken into account.

So that the resistance caused by the tight fit between rotor and stator is distributed homogeneously during the whole of the working cycle, in order to limit to a relatively low value the starting torque necessary and to ensure good pumping efficiency, the force F which the rotor must exert to deform the liner of the stator, during its transverse movements therein, should remain constant at all times.

The broken line curve T in FIG. 2 shows the path really described by the rotor: this path corresponds to a slight penetration by said rotor, to a depth $P_1$, into the semi-circular zones of the stator, and to a penetration more pronounced, to a depth $P_2$, in the rectilinear zones of this stator, corresponding to the inner bosses 5, the difference $P_2 - P_1$ between these two depths corresponding to height $h$ of said inner bosses 5. These two depths $P_1$ and $P_2$ are chosen according to the degrees of fit required of the rotor at the different points considered.

Figure 3:
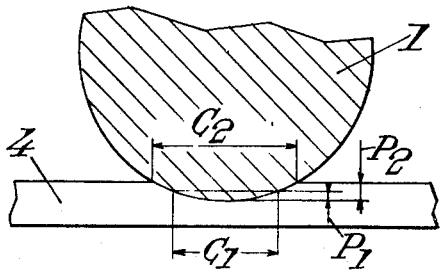

Knowing these values $P_1$ and $P_2$ as well as the diameter D of the rotor, the chords $C_1$ and $C_2$ can be easily deduced, i.e. the lengths of the zones deformed by penetration of the rotor into the resilient liner to respectively depths $P_1$ and $P_2$, as can be seen in FIG. 3.

Figure 4:
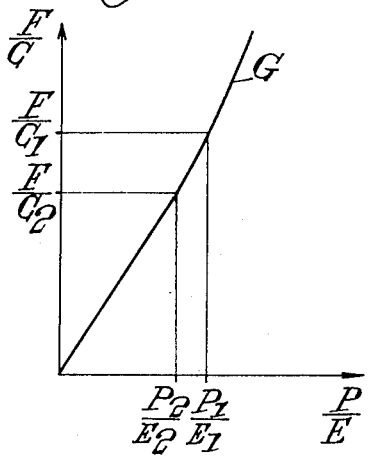
FIGS. 3 and 4 are diagrams for explaining how the thicknesses of the bosses for the resilient stator liner are determined.

FIG. 4 is the compression diagram for the resilient material forming the liner 4: this diagram includes a curve G giving the values of ratio F/C, shown as ordinates, against the compression rate P/E of said material, shown as abscissa, E being the thickness of the compressed layer of this material.

Knowing the values $C_1$, $C_2$, $P_1$, $P_2$ and F, this diagram gives immediately the values $E_1$ and $E_2$.

The value $E_1$ is the minimum thickness of the wall of liner 4, in the curved areas of this liner, and $E_2$ is the maximum thickness of this wall, at right angles to its bosses.

The value of height H of the outside bosses 6 is calculated therefrom, this value being equal to $E_2 - E_1 - h$.

The solution recommended by the invention is intermediate between the two known solutions, for which the juxtaposed surfaces of the rigid body and the resilient lining extended respectively along the broken line curves V (cylindrical rigid body on the inside) and W (resilient lining of constant thickness) of FIG. 2.

It represents a harmonious compromise between these two solutions which removes simultaneously the disadvantages thereof while, at the same time, avoiding the excessive deformability of the lining, as in the first solution, and the too rapid wear of this lining as in the second solution, as well as the difficulty met with this latter in ensuring a tight even fit, without packing, of the rotor.

Of course, the height H of the outer bosses such as defined by calculation hereabove can be increased or reduced, according to whether the emphasis is to be placed on the advantages offered by the first solution above or on the contrary those of the second.

In an embodiment of the invention according to FIGS. 1 and 2, which has given complete satisfaction and which is quoted simply as an illustration, the circular cross-section of the rotor had a diameter of 50 mm and the excentricity of the rotor was 10 mm, the liner 4 had a minimum thickness of 5 mm and depths $P_1$ and $P_2$ were respectively 0.2 and 0.4 mm, which correspond to a maximum height of 0.2 mm for the inner bosses 5 and to a maximum height of approximately 5 to 10 mm for the outer bosses 6.

Figure 5:
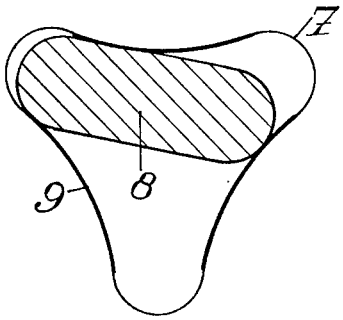
FIG. 5 is a diagram showing the application of the invention to a screw pump having a stator of the three teeth gear type.

As it goes without saying, and as it results moreover from what has gone before, the invention is in no way limited to those embodiments and modes of application which have been more especially considered ; it covers on the contrary all variations, particularly those in which the stator is of a type other than that with "two teeth gears" considered above, being for example of the type with "three teeth gears" such as that shown at 7 in FIG. 5: in this last case, for which rotor 8 is also of the two teeth gear type, and in all other cases which might be contemplated, the liner of the stator is again thickened in those areas (9 in FIG. 5) corresponding to the rubbing at maximum speed between the rotor and the stator, said areas being the central parts of the zones of this liner which are bulged inwards.

I claim:

1. A screw pump stator comprising a rigid tubular body lined on the inside with a resilient sleeve, characterised in that its resilient sleeve(4) is formed by a twisted liner whose thickness varies along the periphery of each transverse section, this thickness being the highest in the zones corresponding to the highest sliding speeds of the rotor, these thickened zones forming bosses (5,6) both on the outside surface and on the inside surface of this liner, and in that its rigid body (3) has an inside surface of generally the same form as that of the inside surface of the twisted liner, but hollowed out at the level of the bosses of this liner so as to receive sealingly the outside bosses of this latter.

2. A stator according to claim 1, characterised in that the maximum thickness of each outside boss (6) is at least ten times greater than the maximum thickness of the corresponding inside boss (5).

3. A stator according to any of claims 1, characterised in that the thickness of each outside boss (6) is greater than the thickness of the wall of the liner (4) in its thinnest portion.

4. A stator according to claim 1, for cooperating with a rotor of circular cross-section of a diameter of 50 mm and excentricity of 10 mm, comprising a relilient liner having a minimum thickness of 5 mm in its most curved areas, characterised in that the maximum thickness of the inside bosses (5) of said liner is approximately 0.2 mm and in that the maximum thickness of the outside bosses (6) of said liner is approximately 5 to 10 mm.

5. A stator according to claim 2, characterized in that the thickness of each outside boss (6) is greater than the thickness of the wall of the liner (4) in its thinnest portion.

* * * * *